US008511796B2

(12) United States Patent
Ghozeil et al.

(10) Patent No.: US 8,511,796 B2
(45) Date of Patent: Aug. 20, 2013

(54) FIRING CELL

(75) Inventors: Adam L. Ghozeil, Corvallis, OR (US); Andrew Phillips, Corvallis, OR (US); David Maxfield, Philomath, OR (US); Eugene J. Mar, Corvallis, OR (US); Matthew P. Heineck, Corvallis, OR (US); Mark H. MacKenzie, Brush Prairie, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 198 days.

(21) Appl. No.: 12/812,751

(22) PCT Filed: Feb. 6, 2008

(86) PCT No.: PCT/US2008/053153

§ 371 (c)(1),
(2), (4) Date: Jul. 14, 2010

(87) PCT Pub. No.: WO2009/099439

PCT Pub. Date: Aug. 13, 2009

(65) Prior Publication Data

US 2011/0080454 A1 Apr. 7, 2011

(51) Int. Cl.
*B41J 2/05* (2006.01)
*B41J 29/38* (2006.01)

(52) U.S. Cl.
USPC ..... 347/62; 347/12; 347/57

(58) Field of Classification Search
None
See application file for complete search history.

(56) References Cited

U.S. PATENT DOCUMENTS

| | | | | |
|---|---|---|---|---|
| 6,162,589 | A | 12/2000 | Chen et al. | |
| 6,481,817 | B1 | 11/2002 | Torgerson et al. | |
| 6,893,104 | B2 | 5/2005 | Tamura | |
| 2003/0016272 | A1 | 1/2003 | Anagnostopoulos et al. | |
| 2004/0113959 | A1 | 6/2004 | Tamura | |
| 2005/0230493 | A1 * | 10/2005 | Benjamin et al. | 239/69 |
| 2007/0076032 | A1 | 4/2007 | Bergstedt et al. | |
| 2007/0081036 | A1 | 4/2007 | Silverbrook | |
| 2007/0229595 | A1 | 10/2007 | Bergstedt et al. | |
| 2007/0291061 | A1 * | 12/2007 | Hu et al. | 347/12 |

FOREIGN PATENT DOCUMENTS

| | | |
|---|---|---|
| CN | 1972804 | 5/2007 |
| JP | 2007-532368 | 11/2007 |
| JP | 2008-511474 | 4/2008 |
| WO | 2006025033 A2 | 3/2006 |

* cited by examiner

*Primary Examiner* — Geoffrey Mruk

(57) ABSTRACT

A system is provided that includes first means for pre-charging a node to a first potential where the node coupled to a switch configured to control current through a firing resistor and second means for selectively discharging the node to a second potential across a path that has only one transistor between the node and the second potential.

12 Claims, 8 Drawing Sheets

FIRING CELL

BACKGROUND

An inkjet printing system, as one embodiment of a fluid ejection system, may include a printhead, an ink supply that provides liquid ink to the printhead, and an electronic controller that controls the printhead. The printhead, as one embodiment of a fluid ejection device, ejects ink drops through a plurality of orifices or nozzles. Electronic components may be used to control the ejection of ink drops through the orifices.

As manufacturing processes that are used to create these electronic components change, it is often desirable to create these electronics using the updated processes. By doing so, a manufacturer may benefit from increased manufacturing efficiencies, cost savings or product yields, for example. The use of an updated process, however, may present challenges in manufacturing a product so that it operates like previous products that were built using different processes.

DETAILED DESCRIPTION

In the following detailed description, reference is made to the accompanying drawings, which form a part hereof, and in which is shown by way of illustration specific embodiments in which the disclosed subject matter may be practiced. It is to be understood that other embodiments may be utilized and structural or logical changes may be made without departing from the scope of the present disclosure. The following detailed description, therefore, is not to be taken in a limiting sense, and the scope of the present disclosure is defined by the appended claims.

According to one embodiment, a pre-charged firing cell configured to selectively energize a firing resistor on a printhead die is provided. When energized by the firing cell, the firing resistor causes droplets of ink within a vaporization chamber on the die to be ejected through a nozzle and toward a print medium. The firing cell operates using a high voltage input signal that pre-charges the cell during a pre-charge cycle and low voltage logic circuitry that selectively causes the firing resistor to be energized during a selective discharge cycle. An attenuated version of the high voltage input signal is used to bias the low voltage logic circuitry during the pre-charge cycle. The logic circuitry includes at least one discharge path with a single transistor that selectively connects a switch that controls current through the firing resistor to a reference potential.

Figure 1:
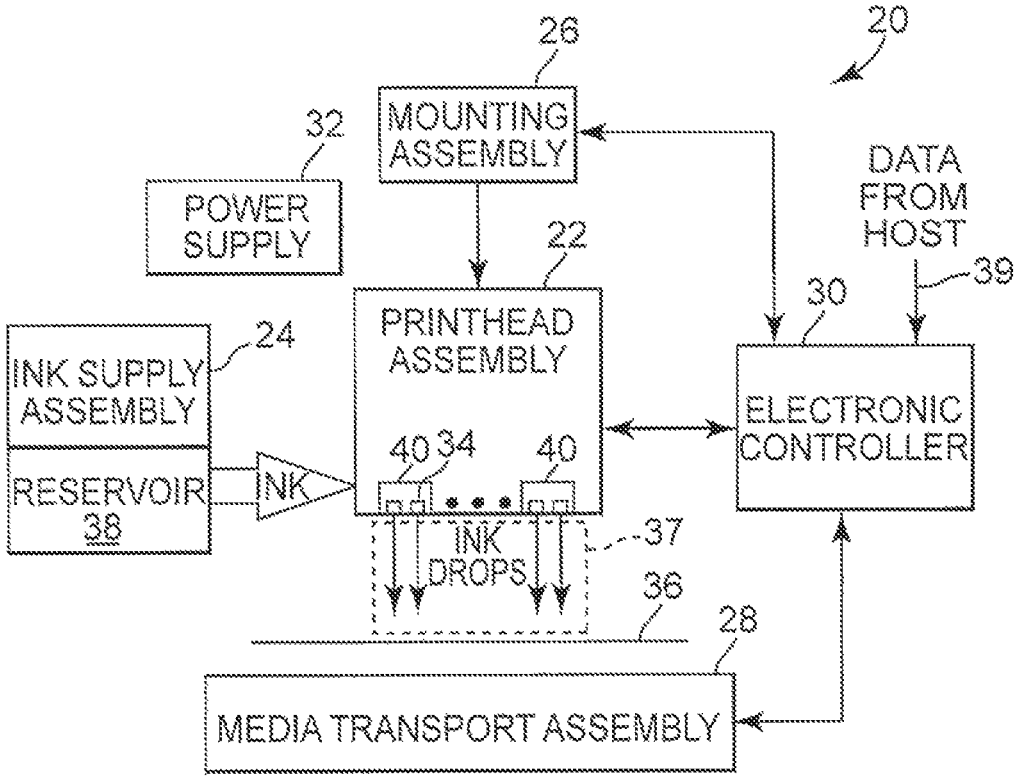
FIG. 1 is a block diagram illustrating one embodiment of an inkjet printing system.

FIG. 1 is a block diagram illustrating one embodiment of an inkjet printing system 20. Inkjet printing system 20 constitutes one embodiment of a fluid ejection system that includes a fluid ejection device, such as inkjet printhead assembly 22, and a fluid supply assembly, such as ink supply assembly 24. The inkjet printing system 20 also includes a mounting assembly 26, a media transport assembly 28, and an electronic controller 30. At least one power supply 32 provides power to the various electrical components of inkjet printing system 20.

In one embodiment, inkjet printhead assembly 22 includes at least one printhead or printhead die 40 that ejects drops of ink through a plurality of orifices or nozzles 34 toward a print medium 36 so as to print onto print medium 36. Printhead 40 is one embodiment of a fluid ejection device. Print medium 36 may be any type of suitable sheet material, such as paper, card stock, transparencies, Mylar, fabric, and the like. Typically, nozzles 34 are arranged in one or more columns or arrays such that properly sequenced ejection of ink from nozzles 34 causes characters, symbols, and/or other graphics or images to be printed upon print medium 36 as inkjet printhead assembly 22 and print medium 36 are moved relative to each other. While the following description refers to the ejection of ink from printhead assembly 22, it is understood that other liquids, fluids or flowable materials, including clear fluid, may be ejected from printhead assembly 22.

Ink supply assembly 24 as one embodiment of a fluid supply assembly provides ink to printhead assembly 22 and includes a reservoir 38 for storing ink. As such, ink flows from reservoir 38 to inkjet printhead assembly 22. Ink supply assembly 24 and inkjet printhead assembly 22 can form either a one-way ink delivery system or a recirculating ink delivery system. In a one-way ink delivery system, substantially all of the ink provided to inkjet printhead assembly 22 is consumed during printing. In a recirculating ink delivery system, only a portion of the ink provided to printhead assembly 22 is consumed during printing. As such, ink not consumed during printing is returned to ink supply assembly 24.

In one embodiment, inkjet printhead assembly 22 and ink supply assembly 24 are housed together in an inkjet cartridge or pen. The inkjet cartridge or pen is one embodiment of a fluid ejection device. In another embodiment, ink supply assembly 24 is separate from inkjet printhead assembly 22 and provides ink to inkjet printhead assembly 22 through an interface connection, such as a supply tube (not shown). In either embodiment, reservoir 38 of ink supply assembly 24 may be removed, replaced, and/or refilled. In one embodiment, where inkjet printhead assembly 22 and ink supply assembly 24 are housed together in an inkjet cartridge, reservoir 38 includes a local reservoir located within the cartridge and may also include a larger reservoir located separately from the cartridge. As such, the separate, larger reservoir serves to refill the local reservoir. Accordingly, the separate, larger reservoir and/or the local reservoir may be removed, replaced, and or refilled.

Mounting assembly 26 positions inkjet printhead assembly 22 relative to media transport assembly 28 and media transport assembly 28 positions print medium 36 relative to inkjet printhead assembly 22. Thus, a print zone 37 is defined adjacent to nozzles 34 in an area between inkjet printhead assembly 22 and print medium 36. In one embodiment, inkjet printhead assembly 22 is a scanning type printhead assembly. As such, mounting assembly 26 includes a carriage (not shown) for moving inkjet printhead assembly 22 relative to media transport assembly 28 to scan print medium 36. In another embodiment, inkjet printhead assembly 22 is a non-scanning type printhead assembly. As such, mounting assembly 26 fixes inkjet printhead assembly 22 at a prescribed position relative to media transport assembly 28. Thus, media transport assembly 28 positions print medium 36 relative to inkjet printhead assembly 22.

Electronic controller or printer controller 30 typically includes a processor, firmware, and other electronics, or any combination thereof, for communicating with and controlling inkjet printhead assembly 22, mounting assembly 26, and media transport assembly 28. Electronic controller 30 receives data 39 from a host system, such as a computer, and usually includes memory for temporarily storing data 39. Typically, data 39 is sent to inkjet printing system 20 along an electronic, infrared, optical, or other information transfer path. Data 39 represents, for example, a document and/or file to be printed. As such, data 39 forms a print job for inkjet printing system 20 and includes one or more print job commands and/or command parameters.

In one embodiment, electronic controller 30 controls inkjet printhead assembly 22 for ejection of ink drops from nozzles 34. As such, electronic controller 30 defines a pattern of ejected ink drops that form characters, symbols, and/or other graphics or images on print medium 36. The pattern of ejected ink drops is determined by the print job commands and/or command parameters.

In one embodiment, inkjet printhead assembly 22 includes one printhead 40. In another embodiment, inkjet printhead assembly 22 is a wide-array or multi-head printhead assembly. In one wide-array embodiment, inkjet printhead assembly 22 includes a carrier, which carries printhead dies 40, provides electrical communication between printhead dies 40 and electronic controller 30, and provides fluidic communication between printhead dies 40 and ink supply assembly 24.

Figure 2:
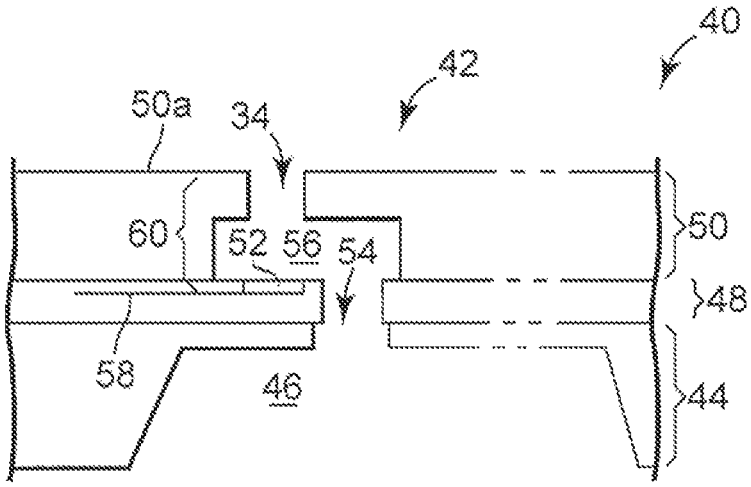
FIG. 2 is a diagram illustrating a portion of one embodiment of a printhead die.

FIG. 2 is a diagram illustrating a portion of one embodiment of a printhead die 40. The printhead die 40 includes an array of printing or fluid ejecting elements 42. Printing elements 42 are formed on a substrate 44, which has an ink feed slot 46 formed therein. As such, ink feed slot 46 provides a supply of liquid ink to printing elements 42. Ink feed slot 46 is one embodiment of a fluid feed source. Other embodiments of fluid feed sources include but are not limited to corresponding individual ink feed holes feeding corresponding vaporization chambers and multiple shorter ink feed trenches that each feed corresponding groups of fluid ejecting elements. A thin-film structure 48 has an ink feed channel 54 formed therein which communicates with ink feed slot 46 formed in substrate 44. An orifice layer 50 has a front face 50*a* and a nozzle opening 34 formed in front face 50*a*. Orifice layer 50 also has a nozzle chamber or vaporization chamber 56 formed therein which communicates with nozzle opening 34 and ink feed channel 54 of thin-film structure 48. A firing resistor 52 is positioned within vaporization chamber 56 and leads 58 electrically couple firing resistor 52 to circuitry controlling the application of electrical current through selected firing resistors. A drop generator 60 as referred to herein includes firing resistor 52, nozzle chamber or vaporization chamber 56 and nozzle opening 34.

During printing, ink flows from in feed slot 46 to vaporization chamber 56 via in feed channel 54. Nozzle opening 34 is operatively associated with firing resistor 52 such that droplets of ink within vaporization chamber 56 are ejected through nozzle opening 34 (e.g., substantially normal to the plane of firing resistor 52) and toward print medium 36 upon energization of firing resistor 52.

Example embodiments of printhead dies 40 include a thermal printhead, a piezoelectric printhead, an electrostatic printhead, or any other type of fluid ejection device known in the art that can be integrated into a multi-layer structure. Substrate 44 is formed, for example, of silicon, glass, ceramic, or a stable polymer and thin-film structure 48 is formed to include one or more passivation or insulation layers of silicon dioxide, silicon carbide, silicon nitride, tantalum, polysilicon glass, or other suitable material. Thin-film structure 48 also includes at least one conductive layer, which defines firing resistor 52 and leads 58. The conductive layer is made, for example, to include aluminum, gold, tantalum, tantalum-aluminum, or other metal or metal alloy. In one embodiment, firing cell circuitry, such as described in detail below, is implemented in substrate and thin-film layers, such as substrate 44 and thin-film structure 48.

In one embodiment, orifice layer 50 comprises a photoimageable epoxy resin, for example, an epoxy referred to as SU8, marketed by Micro-Chem, Newton, Mass. Exemplary techniques for fabricating orifice layer 50 with SU8 or other polymers are described in detail in U.S. Pat. No. 7,226,149, which is herein incorporated by reference.

Figure 3:
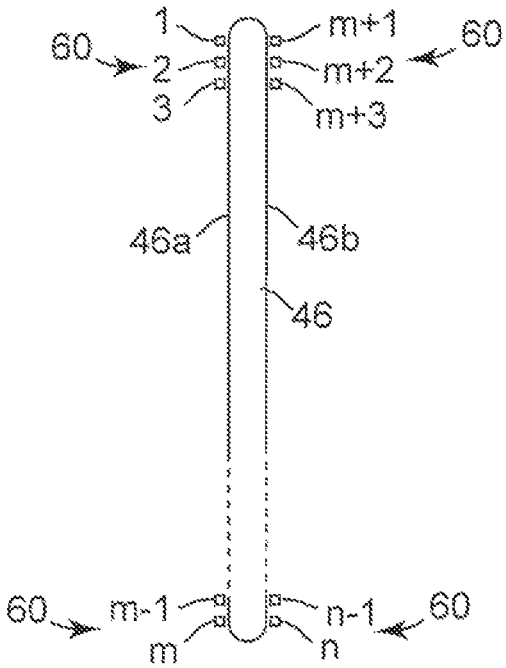
FIG. 3 is a diagram illustrating a layout of drop generators located along an ink feed slot in one embodiment of a printhead die.

FIG. 3 is a diagram illustrating drop generators 60 located along ink feed slot 46 in one embodiment of printhead die 40. Ink feed slot 46 includes opposing ink feed slot sides 46*a* and 46*b*. Drop generators 60 are disposed along each of the opposing ink feed slot sides 46*a* and 46*b*. A total of n drop generators 60 are located along ink feed slot 46, with m drop generators 60 located along ink feed slot side 46*a*, and n−m drop generators 60 located along ink feed slot side 46*b*. In one embodiment, n equals 200 drop generators 60 located along ink feed slot 46 and m equals 100 drop generators 60 located along each of the opposing ink feed slot sides 46*a* and 46*b*. In other embodiments, any suitable number of drop generators 60 can be disposed along ink feed slot 46.

Ink feed slot 46 provides ink to each of the n drop generators 60 disposed along ink feed slot 46. Each of the n drop generators 60 includes a firing resistor 52, a vaporization chamber 56 and a nozzle 34. Each of the n vaporization chambers 56 is fluidically coupled to in feed slot 46 through at least one ink feed channel 54. The firing resistors 52 of drop generators 60 are energized in a controlled sequence to eject fluid from vaporization chambers 56 and through nozzles 34 to print an image on print medium 36.

FIG. 2 is a diagram illustrating a portion of one embodiment of a printhead the 40. The printhead the 40 includes an array of printing or fluid ejecting elements 42. Printing elements 42 are formed on a substrate 44, which has an ink feed to 46 formed therein. As such, ink feed slot 46 provides a supply of liquid ink to printing elements 42. Ink feed slot 46 is one embodiment of a fluid feed source. Other embodiments of fluid feed sources include but are not limited to corresponding individual ink feed holes feeding corresponding vaporization chambers and multiple shorter ink feed trenches that each feed corresponding groups of fluid ejecting elements. A thin-film structure 48 has an ink feed channel 54 formed therein which communicates with ink feed slot 46 formed in substrate 44. A layer 50 has a top face 50*a* and a nozzle opening 34 formed in top face 50*a*. Layer 50 also has a nozzle chamber or vaporization chamber 56 formed therein which communicates with nozzle opening 34 and ink feed channel 54 of thin-film structure 48. A firing resistor 52 is positioned within vaporization chamber 56 and leads 58 electrically couple firing resistor 52 to circuitry controlling the application of electrical current through selected firing resistors. A drop generator 60 as referred to herein includes firing resistor 52, nozzle chamber or vaporization chamber 56 and nozzle opening 34.

During printing, ink flows from ink feed slot 46 to vaporization chamber 56 via ink feed channel 54. Nozzle opening 34 is operatively associated with firing resistor 52 such that droplets of ink within vaporization chamber 56 are ejected through nozzle opening 34 (e.g., substantially normal to the plane of firing resistor 52) and toward print medium 36 upon energization of firing resistor 52.

Example embodiments of printhead dies 40 include a thermal printhead, a piezoelectric printhead, an electrostatic printhead, or any other type of fluid ejection device known in the art that can be integrated into a multi-layer structure. Substrate 44 is formed, for example, of silicon, glass, ceramic, or a stable polymer and thin-film structure 48 is formed to include one or more passivation or insulation layers of silicon dioxide, silicon carbide, silicon nitride, tantalum, polysilicon glass, or other suitable material. Thin-film structure 48 also includes at least one conductive layer, which defines firing resistor 52 and leads 58. The conductive layer is made, for example, to include aluminum, gold, tantalum, tantalum-aluminum, or other metal or metal alloy.

In one embodiment, layer 50 comprises a photoimageable epoxy resin, for example, an epoxy referred to as SU8, marketed by Micro-Chem, Newton, Mass. Exemplary techniques for fabricating layer 50 with SU8 or other polymers are described in detail in U.S. Patent Application Publication No. 2005/0270332, which is herein incorporated by reference. Other suitable materials, however, can be employed to form layer 50.

FIG. 3 is a diagram illustrating drop generators 60 located along ink feed slot 46 in one embodiment of printhead die 40. Ink feed slot 46 includes opposing ink feed slot sides 46*a* and 46*b*. Drop generators 60 are disposed along each of the opposing ink feed slot sides 46*a* and 46*b*. A total of n drop generators 60 are located along ink feed slot 46, with m drop generators 60 located along ink feed slot side 46*a*, and n−m drop generators 60 located along ink feed slot side 46*b*. In one embodiment, n equals 200 drop generators 60 located along ink feed slot 40 and m equals 100 drop generators 60 located along each of the opposing ink feed slot sides 46*a* and 46*b*. In other embodiments, any suitable number of drop generators 60 can be disposed along ink feed slot 46.

Ink feed slot 46 provides ink to each of the n drop generators 60 disposed along ink feed slot 46. Each of the n drop generators 60 includes a firing resistor 52, a vaporization chamber 56 and a nozzle 34. Each of the n vaporization chambers 56 is fluidically coupled to ink feed slot 46 through at least one ink feed channel 54. The firing resistors 52 of drop generators 60 are energized in a controlled sequence to eject fluid from vaporization chambers 56 and through nozzles 34 to print an image on print medium 36.

Figure 4B:
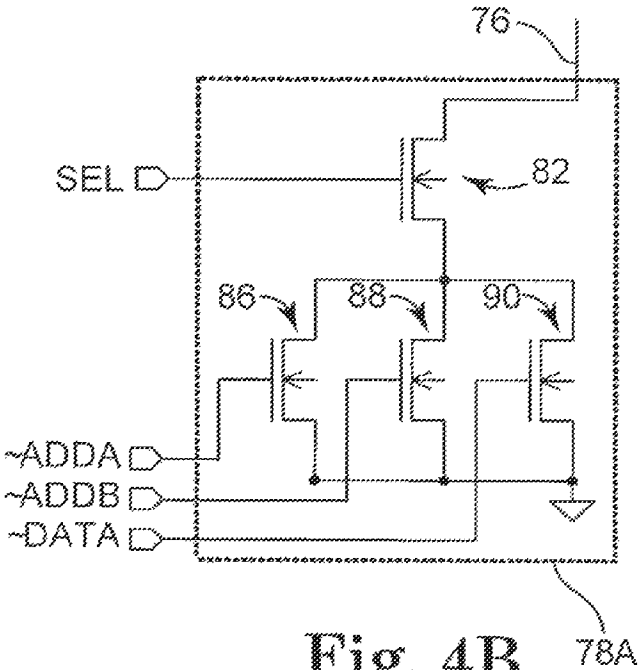
FIGS. 4A-4C are diagrams illustrating the operation of one embodiment or a pre-charged firing cell.
Figure 4A:
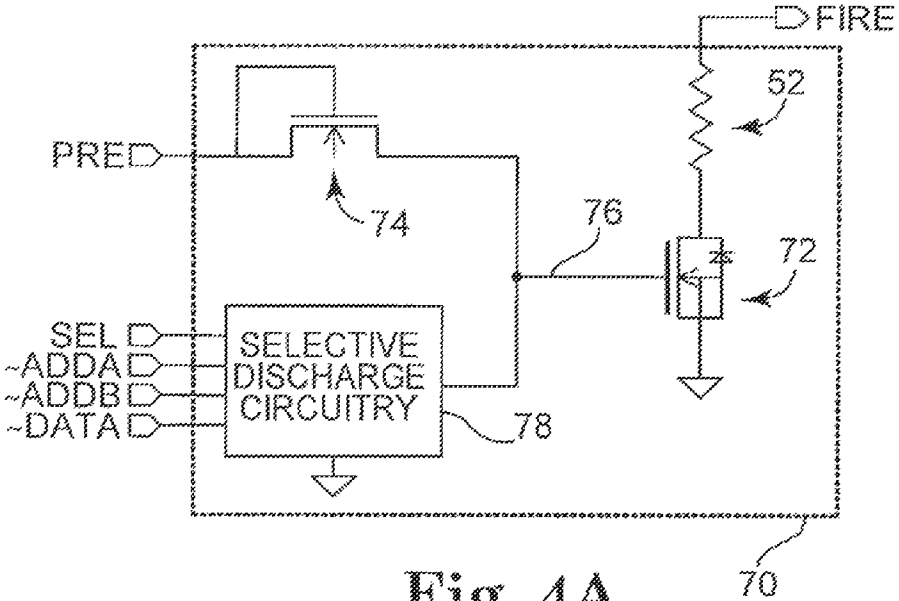
Figure 4C:
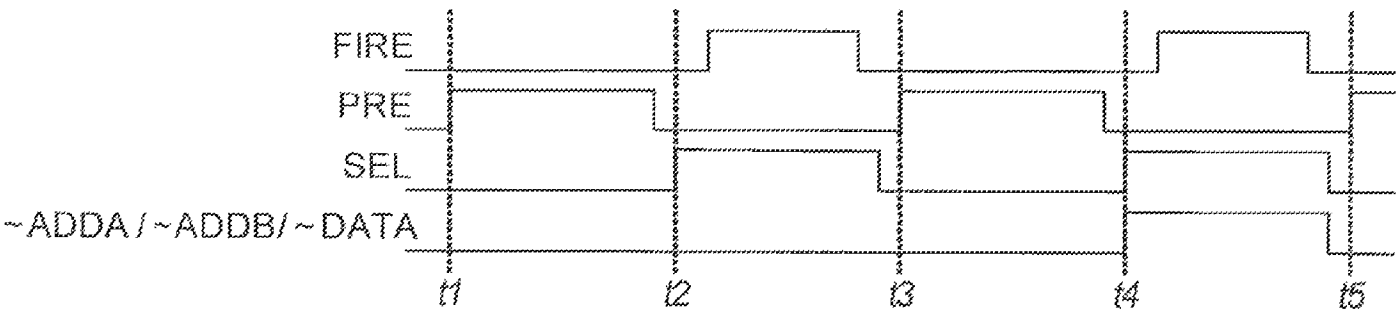

FIGS. 4A-4C are diagrams illustrating the operation of one embodiment of a pre-charged firing cell 70. Referring to FIG. 4A, pre-charged firing cell 70 operates to selectively energize firing resistor 52 using a drive switch 72 in response to a select signal (SEL), two address signals (~ADDA and ~ADDB), a data signal (~DATA), and a fire signal (FIRE). As described above with reference to FIG. 2, firing resistor 52 causes droplets of ink within vaporization chamber 56 to be ejected through nozzle opening 34 and toward print medium 36 when energized.

Drive switch 72 is a transistor with a drain-source path electrically coupled at one end to one terminal of firing resistor 52 and at the other end to a reference potential such as ground. The other terminal of firing resistor 52 electrically couples to a fire line that receives the fire signal. The fire signal includes energy pulses that energize firing resistor 52 if drive switch 72 is turned on (i.e., conducting) and do not energize firing resistor 52 if drive switch 72 is turned off (i.e., not conducting). Drive switch 72, therefore, controls the energy applied to (i.e., the current through) firing resistor 52. The gate of drive switch 72 electrically couples to a node 76 that also electrically couples to a drain-source path of a pre-charge transistor 74 and selective discharge circuitry 78.

Firing cell 70 operates during two sequential and mutually exclusive cycles: a pre-charge cycle and a selective discharge cycle. FIG. 4C illustrates signal levels of the fire, pre-charge, select, address, and data signals for example pre-charge cycles between times t1 and t2 and between times t3 and t4. FIG. 4C illustrates signal levels of the fire, pre-charge, select, address, and data signals for example selective discharge cycles between times t2 and t3 and between times t4 and t5.

During each pre-charge cycle, the pre-charge signal provides a high voltage pulse across a pre-charge transistor 74 to pre-charge node 76 to a pre-charge voltage level that is sufficient to turn on drive switch 72 as shown in FIGS. 4A and 4C. The select signal is at a low logic level during pre-charge cycles to prevent selective discharge circuitry 78 from discharging node 76 during pre-charge cycles and allow node 76 to charge to and remain at the pre-charge voltage level.

During each selective discharge cycle, the pre-charge signal is at a low logic level and the select signal transitions to a high logic level. The address signals and the data signals control the operation of drive switch 72 in each selective discharge cycle by either causing node 76 to remain at the pre-charge voltage level (i.e., leave drive switch 72 turned on) or causing node 76 to discharge to ground or another reference potential (i.e., turn drive switch 72 off). When the fire signal is asserted, firing resistor 52 energizes if drive switch 72 is turned on and does not energize if drive switch 72 is turned off.

In the embodiment shown in FIG. 4C, the address signals and the data signals are each active when low, as indicated by the '~' symbol preceding the name of each signal. In this embodiment, firing resistor 52 is energized during the selective discharge cycle only if the address and data signals are all at low logic levels when the fire signal is asserted. If one or more of the address or data signals are at a high logic level when the fire signal is asserted, firing resistor 52 is not energized during the selective discharge cycle. Accordingly, firing resistor 52 is energized during the selective discharge cycle between times t2 and t3 in the example of FIG. 4C because all of the address and data signals are at low logic levels. Likewise, firing resistor 52 is not energized during the selective discharge cycle between times t4 and t5 because one or more of the address and data signals are at a high logic level.

In one embodiment shown in FIG. 4B, an embodiment 78A of selective discharge circuitry 78 includes a transistor 82 configured as a pass gate controlled by the select and three parallel transistors 86, 88, and 90 configured as a NOR gate controlled by the address and data signals. During the pre-charge cycle, the select signal turns of transistor 82 to prevent node 76 from discharging to ground through any of transistors 86, 88, and 90. During the selective discharge cycle, the select signal turns on transistor 82 to cause node 76 to discharge to ground if any of transistors 86, 88, and 90 are turned on by the respective address or data lines.

In one embodiment, firing cell 70 may be constructed in a CMOS process using only resistors, NMOS transistors, and high-voltage NMOS (HVNMOS) transistors. In particular, drive switch 72 may be constructed as HVNMOS transistor and transistor 74 and selective discharge circuitry 78 may be constructed with NMOS transistors that have low voltage, thin gate oxides. In addition, a high voltage input signal may form the source for the pre-charge signal and may be used to pre-charge node 76.

When formed in a CMOS process, transistor 72 and any transistors in selective discharge circuitry 78 may not be able to tolerate high voltages at the gate terminals. High voltages at a gate terminal could result in a high voltage between the gate and source connections and damage the thin gate oxide of a CMOS transistor. To use a high voltage input signal as the source for the pre-charge signal, the high voltage input signal is attenuated to a voltage level that is suitable for drive switch 72. Circuitry used to attenuate the high voltage input signal, however, may limit the operating frequencies of firing cell 70.

In addition, CMOS transistors may have higher capacitances compared to transistors formed with other processes. The higher capacitances of transistors formed by a CMOS process may also limit the operating frequencies of firing cell 70.

For example, in the embodiment of FIG. 4B, selective discharge circuitry 78A may not sufficiently discharge node 76 at higher operating frequencies when formed in a CMOS process. With the operating lower voltages and increased capacitances of a CMOS process, the series configuration of transistor 82 and the set of transistors 86, 88, and or 90 in parallel may not electrically couple node 76 to the reference potential fast enough to sufficiently discharge node 76 and prevent drive switch 72 from remaining turned on at higher operating frequencies. The incomplete or partial voltage discharge at node 76 may cause spurious sub-firing in drop generators 60 that are not selected to fire. The sub-firing may also increase the temperature of printhead die 40 and further slow the discharge of node 76 in subsequent selective discharge cycles. This additional slowing may cause additional sub-firing to occur and result in a thermal run-away situation.

Figure 5:
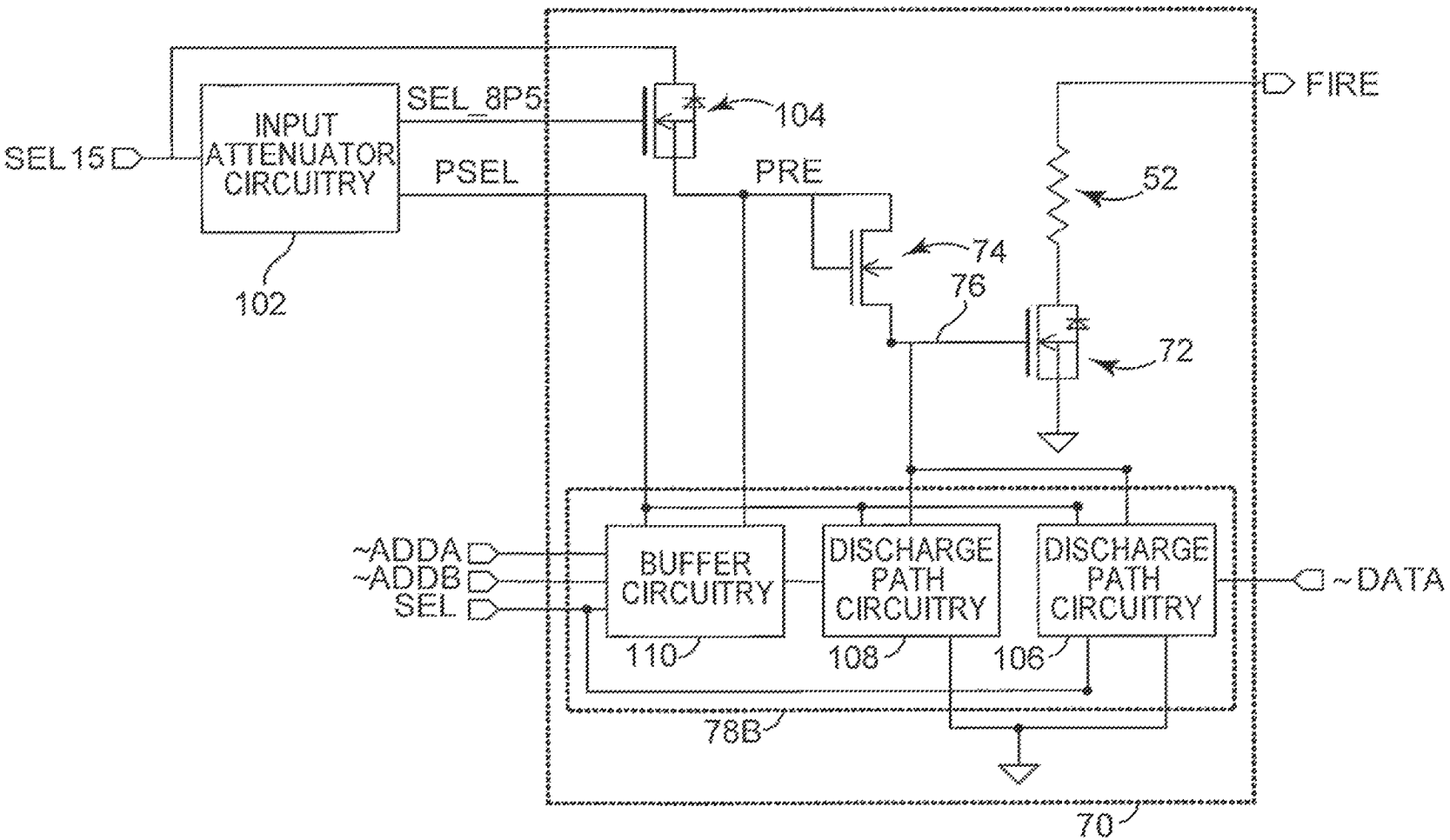
FIG. 5 is a diagram illustrating one embodiment of a pre-charged firing cell.

FIG. 5 is a diagram illustrating one embodiment of pre-charged firing cell 70 and input attenuator circuitry 102. In the embodiment of FIG. 5, pre-charged firing cell 70 receives a high voltage input signal (SEL15) and lower voltage versions of the high voltage input signal (SEL_8P5 and PSEL) that have been attenuated by input attenuator circuitry 102. Pre-charged firing cell 70 also includes a distributed level shifter 104 (i.e., a diode connected transistor) and an embodiment of selective discharge circuitry 78B.

Input attenuator circuitry 102 receives the high voltage input signal (SEL15) and attenuates the high voltage input signal to generate lower voltage signals (SEL_8P5 and PSEL) of the high voltage signal. In one embodiment, input attenuator circuitry 102 receives SEL15 from a source (not shown) that is external to printhead die 40, and SEL15 is approximately a 15 volt signal. In other embodiments, SEL15 may be receive from a source on printhead die 40 and/or may have another voltage level. In one embodiment, input attenuator circuitry 102 generates SEL_8P5 to be an approximately 8.5 volt signal using SEL15 and PSEL to be an approximately 6 volt signal using SEL15. In other embodiments, input attenuator circuitry 102 generates SEL15 and PSEL with other voltage levels. Input attenuator circuitry 102 provides SEL_8P5 and PSEL to firing cell 70. Additional details of an embodiment of input attenuator circuitry 102 will be described below with reference to FIG. 6.

Firing cell 70 receives SEL15 from the source and SEL_8P5 and PSEL from input attenuator circuitry 102. SEL15 connects to the source terminal of distributed level shifter 104, and SEL_8P5 connects to the gate terminal of distributed level shifter 104. Distributed level shifter 104 operates to generate the pre-charge signal (PRE) at the source terminal with a potential that is approximately 1.5 volts lower than SEL_8P5. Accordingly, distributed level shifter 104 generates PRE to be an approximately 7 volt signal using SEL15 and SEL_8P5 in one embodiment. The source terminal of distributed level shifter 104 connects to the gate and drain terminals of transistor 74 and to and selective discharge circuitry 78B to allow distributed level shifter 104 to provide PRE to transistor 74 and selective discharge circuitry 78B. PSEL is provided from input attenuator circuitry 102 to selective discharge circuitry 78B.

SEL15, SEL_8P5, PSEL, and PRE all generated to be substantially synchronous and follow the signaling convention of PRE shown in FIG. 4C. During the pre-charge cycle of firing cell 70, PRE pre-charges node 76 across transistor 74 to a potential that is approximately 1.5 volts lower than PRE. The source terminal of transistor 74 connects to node 76. Accordingly, PRE pre-charges node 76 to approximately 5.5 volts in one embodiment.

Selective discharge circuitry 78B is configured to not provide a conductive path between node 76 and a reference potential (e.g., ground) during, the pre-charge cycle of firing cell 70 and to selectively provide a conductive path between node 76 and the reference potential during the selective discharge cycle of firing cell 70. By selectively providing a conductive path between node 76 and the reference potential during the selective discharge cycle, selective discharge circuitry 78B may selectively discharge node 76 to the reference potential. If selective discharge circuitry 78B discharges node 76 to the reference potential, the gate terminal of drive switch 72, which is directly connected to node 76, is reduced from the pre-charge potential to the reference potential to turn off drive switch 72 and prevent firing resistor 52 from being energized. If selective discharge circuitry 78B does not discharge node 76 to the reference potential, the gate terminal of drive switch 72 remains at the pre-charge potential to the reference potential and turns on drive switch 72 to allow firing resistor 52 to be energized by the FIRE signal.

Selective discharge circuitry 78B includes discharge path circuitry 106, discharge path circuitry 108, and buffer circuitry 110. Discharge path circuitry 106 selectively discharges node 76 to the reference potential in response to the data (~DATA) and select (SEL) signals during each selective discharge cycle firing cell 70. Discharge path circuitry 106 includes a conductive path that has only one transistor (e.g., transistor MN14 shown in FIG. 7) between node 76 and the reference potential. The drain terminal of the transistor connects directly to node 76 and the source terminal of the transistor connects directly to the reference potential so that the source-drain path of the transistor forms the conductive path when a sufficient voltage is applied to the gate connection of the transistor. Logic circuitry (e.g., pass gate PASS2 in FIG. 7) receives the data and select signals as inputs and provides an output to the gate connection of the transistor to control the operation of the transistor. The logic circuitry operates in accordance with the signaling convention of ~DATA and SEL shown in FIG. 4C and described above. Accordingly, the logic circuitry turns on the transistor to discharge node 76 and turns off the transistor to prevent node 76 from being discharged across the transistor. Discharge path circuitry 106 also includes circuitry (e.g., transistor MN13 shown in FIG. 7) that is responsive to PSEL and configured to ensure that the discharge path transistor is turned off during the pre-charge cycle.

Discharge path circuitry 108 selectively discharges node 76 to the reference potential in response to an output signal from buffer circuitry 110 during each selective discharge cycle of firing cell 70. Buffer circuitry 110 generates the output signal in response to the address (~ADDA and ~ADDB) and select (SEL) signals. Discharge path circuitry 108 includes a conductive path that has only one transistor (e.g., transistor MN1 shown in FIG. 7) between node 76 and the reference potential. The drain terminal of the transistor connects directly to node 76 and the source terminal of the transistor connects directly to the reference potential so that the source-drain path of the transistor forms the conductive path when a sufficient voltage is applied to the gate connection of the transistor. Buffer circuitry 110 receives the address and select signals as inputs and provides the output signal to the gate connection of the transistor to control the operation of the transistor. Buffer circuitry 110 operates in accordance with the signaling convention of ~ADDA, ~ADDB, and SEL shown in FIG. 4C and described above. Accordingly, buffer circuitry 110 turns on the transistor to discharge node 76 and turns of the transistor to prevent node 76 from being discharged across the transistor. Discharge path circuitry 108 also includes circuitry (e.g., transistor MN9 shown in FIG. 7) that is responsive to PSEL and configured to ensure that the discharge path transistor is turned off during the pre-charge cycle.

Figure 7:
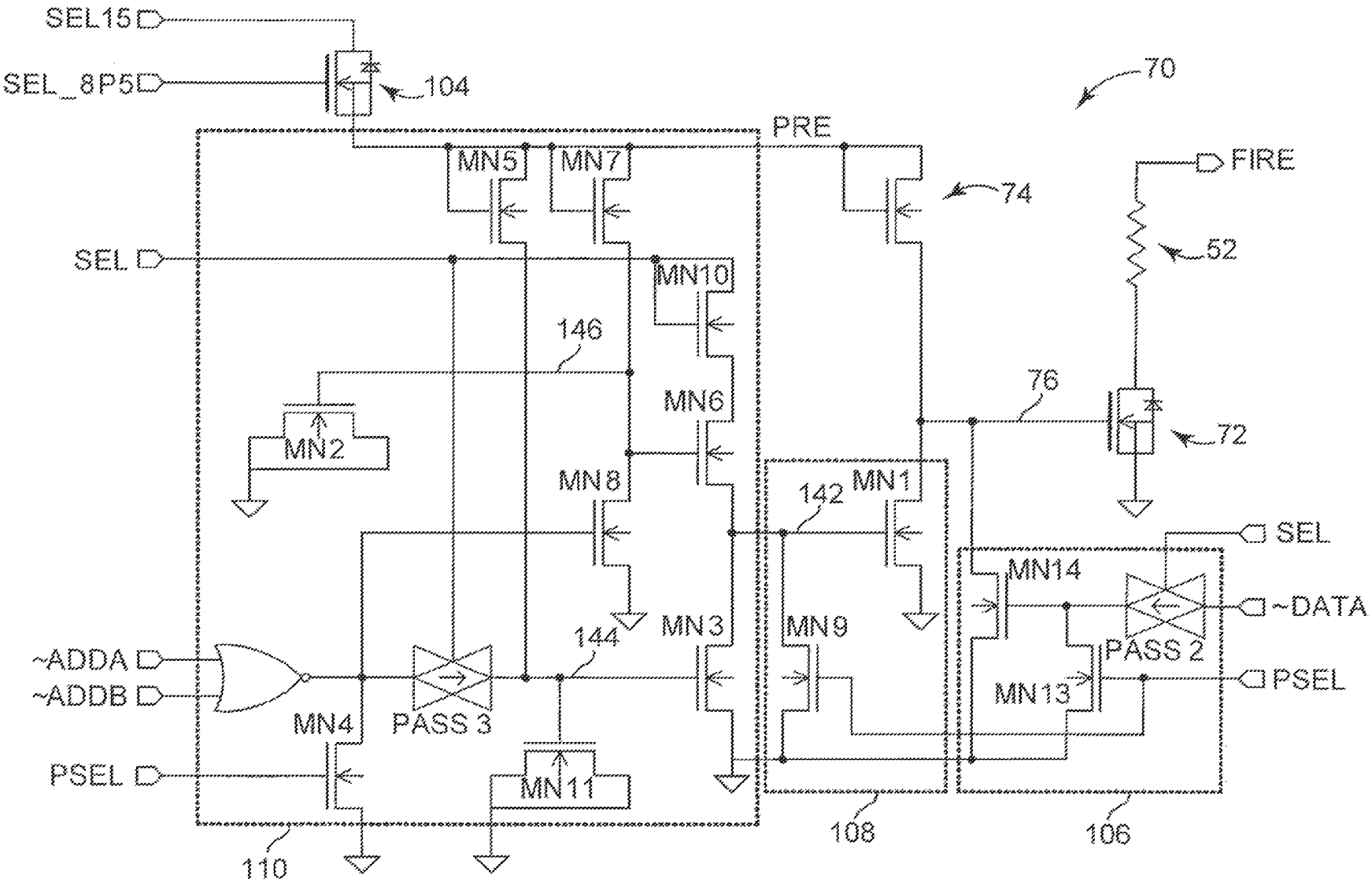
FIG. 7 is a diagram illustrating additional details of one embodiment of a pre-charged firing cell.

To ensure that discharge path circuitry 108 sufficiently discharges node 76 during each selective discharge cycle (i.e., prior to the subsequent pre-charge cycle), buffer circuitry 110 includes one or more buffers (e.g., transistors MN2 and MN11 connected to form capacitors shown in FIG. 7) for storing charge supplied by the pre-charge signal PRE. The pre-charge signal biases these buffers during each pre-charge cycle so that the output signal from buffer circuitry 110 turns on the discharge path transistor of discharge path circuitry 108 fast enough to sufficiently discharge node 76. Buffer circuitry 110 also includes circuitry (e.g., transistors MN4 and MN8 shown in FIG. 7) that is responsive to PSEL and configured to ensure that the buffers are not discharged during the pre-charge cycle.

In the embodiment of FIG. 5, firing cell 70 may be constructed using a CMOS process with only resistors (e.g., firing resistor 52), NMOS transistors (e.g. transistor 74 and selective discharge circuitry 78B), and high-voltage NMOS (HVNMOS) transistors (e.g., drive switch 72 and distributed level shifter 104). The HVNMOS transistors may be formed as lateral double-diffused MOS (LDMOS) transistors in one embodiment.

In other embodiments, the data signal may be used in addition to the address signals to control discharge path circuitry 108 and discharge path circuitry 106 may be omitted. In this embodiment, buffer circuitry 110 receives the data signal and causes discharge path circuitry 108 to discharge node 76 if any of the address signals or the data signal are asserted during a selective discharge cycle. The data signal may be generated such that it is valid prior to the select signal being asserted in this embodiment.

Figure 6:
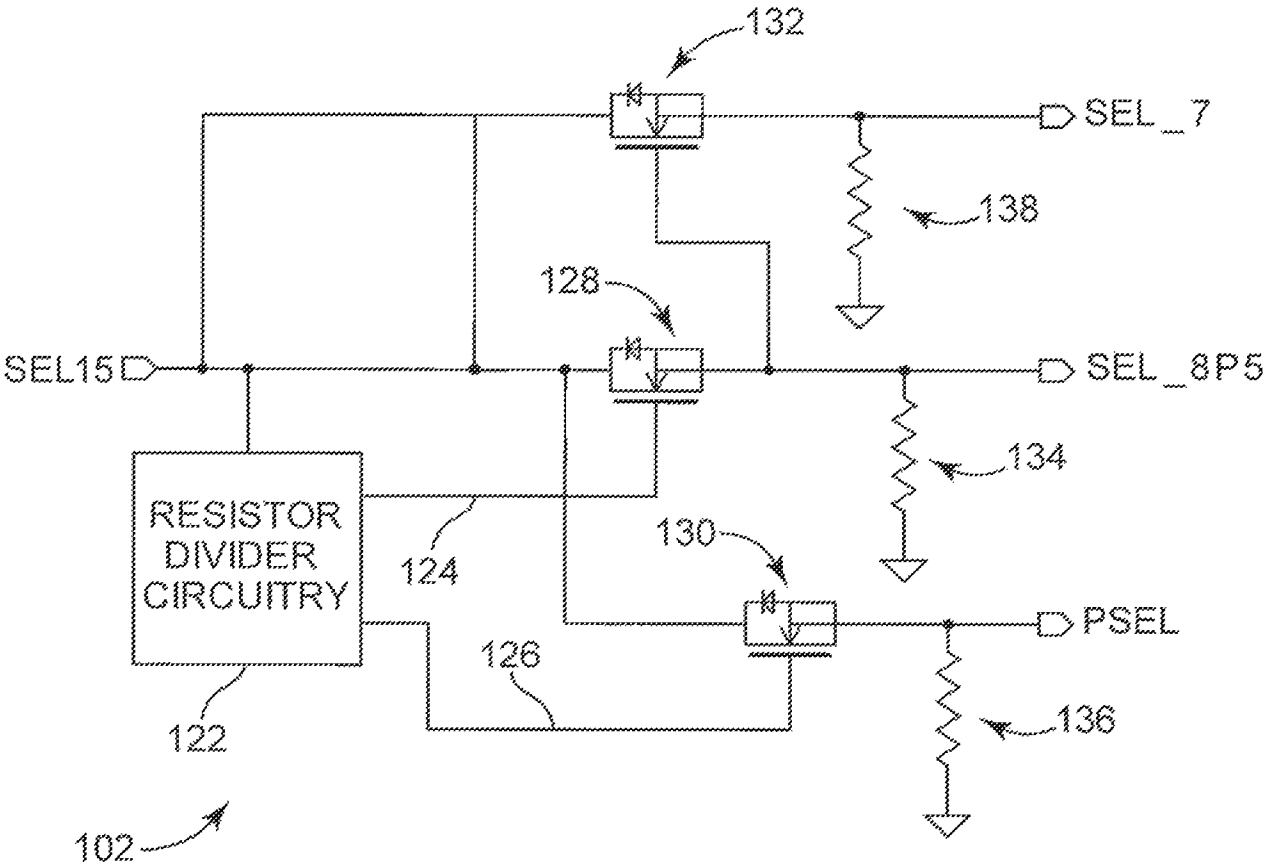
FIG. 6 is a diagram illustrating one embodiment of attenuator circuitry.

FIG. 6 is a diagram illustrating one embodiment of input attenuator circuitry 102. Input attenuator circuitry 102 receives the high voltage input signal SEL15 and attenuates the high voltage input signal to generate lower voltage signals SEL_7, SEL_8P5, and PSEL. In one embodiment where SEL15 is an approximately 15 volt signal, input attenuator circuitry 102 generates SEL_7, SEL_8P5, and PSEL to be approximately 7, 8.5, and 6 volt signals, respectively.

Input attenuator circuitry 102 includes resistor divider circuitry 122. Resistor divider circuitry 122 divides down SEL15 to generate signals 124 and 126 with respective output voltages. Where SEL15 is an approximately 15 volt signal, resistor divider circuitry 122 generates signals 124 and 126 to be approximately 10 and 7.5 volt signals, respectively. Input attenuator circuitry 102 also includes level shifters 128, 130, and 132 (i.e., diode connected transistors). Level shifters 128, 130, and 132 attenuate SEL15 to generate lower voltage output signals. Level shifters 128, 130, and 132 also form buffers that provide sufficient current to pre-charge node 76 and bias buffer circuitry 110.

SEL15 connects to the source terminal of level shifter 128, and signal 124 connects to the gate terminal of level shifter 128. Level shifter 128 generates SEL_8P5 at the source terminal with a potential that is approximately 1.5 volts lower than signal 124. Accordingly, level shifter 128 generates SEL_8P5 to be an approximately 8.5 volt signal in one embodiment.

SEL15 also, connects to the source terminal of level shifter 130, and signal 126 connects to the gate terminal of level shifter 130. Level shifter 130 generates PSEL at the source terminal with a potential that is approximately 1.5 volts lower than signal 126. Accordingly, level shifter 130 generates PSEL to be an approximately 6 volt signal in one embodiment.

SEL15 further connects to the source terminal of level shifter 132, and SEL_8P5 connects to the gate terminal of level shifter 132. Level shifter 132 generates SEL_7 at the source terminal with a potential that is approximately 1.5 volts lower than SEL_8P5. Accordingly, level shifter 132 generates SEL_7 to be an approximately 7 volt signal in one embodiment.

Input attenuator circuitry 102 further includes pulldown resistors 134, 136, and 138 connected between the outputs of level shifters 128, 130, and 132, respectively, and a reference potential (e.g., ground). Pulldown resistors 134, 136, and 138 each provide a small load to draw a minimum amount of current flows through level shifters 128, 130, and 132, respectively, to ensure that difference SEL_8P5, SEL_7, and PSEL remain approximately 1.5 volts lower than the signals at the gates of level shifters 128, 130, and 132, respectively.

In other embodiments, a stack of diodes or diode connected transistors may be used in place of resistor divider circuitry 122.

In other embodiments of firing cell 70, SEL_7 may be used as the pre-charge signal PRE and distributed level shifter 104 may be omitted.

FIG. 7 is a diagram illustrating additional details of discharge path circuitry 106, discharge path circuitry 108, and buffer circuit 110 in one embodiment of pre-charged firing cell 70.

As described above, SEL15, SEL_8P5, PSEL, and PRE are asserted during the pre-change cycle and deasserted during the selective discharge cycle. The select signal SEL is deasserted during the pre-charge cycle and is asserted during the selective discharge cycle. The address signals ~ADDA and ~ADDB and the data signal ~DATA are active low signals in the embodiment of FIG. 7.

Discharge path circuitry 106 operates in response to PSEL, SEL, and ~DATA to allow node 76 to pre charge during the pre-charge cycle and selectively discharge node 76 during the selective discharge cycle. Discharge circuitry 106 includes a discharge path transistor MN14 with a drain terminal directly connected to node 76, a source terminal directly connected to a reference potential, and a gate terminal connected to an output from a pass gate PASS2. Transistor MN14 is configured to connect node 76 to the reference potential across the drain-source path (i.e., discharge node 76) in response to being turned on by the output from pass gate PASS2 and not connect node 76 to the reference potential in response to being turned off by the output from pass gate PASS2. The select signal SEL turns on pass gate PASS2 to transmit the data signal ~DATA as the output of pass gate PASS 2 to the gate terminal of transistor MN14.

A transistor MN13 in discharge path circuitry 106 has a drain terminal connected to the gate terminal of transistor MN14, a source terminal connected to a reference potential, and a gate terminal connected to PSEL. Transistor MN13 is configured to connect the gate terminal of transistor MN14 to the reference potential (i.e., turn off transistor MN14) in response to being turned on by PSEL and not connect the gate terminal of transistor MN14 to the reference potential (i.e., turn on transistor MN14) in response to being turned off by PSEL.

Discharge path circuitry 108 operates in response to PSEL and an output 142 from buffer circuitry 110 to allow node 76 to pre-charge during the pre-charge cycle and selectively discharge node 76 during the selective discharge cycle. Discharge path circuitry 108 includes a discharge path transistor MN1 with a drain terminal directly connected to node 76, a source terminal directly connected to a reference potential, and a gate terminal connected to output 142 of buffer circuitry 110. Transistor MN1 is configured to connect node 76 to the reference potential across the drain-source path (i.e., discharge node 76) in response to being turned on by output 142 and not connect node 76 to the reference potential in response to being turned off by output 142.

A transistor MN9 in discharge path circuitry 108 has a drain terminal, connected to the gate terminal of transistor MN1, a source terminal connected to a reference potential, and a gate terminal connected to PSEL. Transistor MN9 is configured to connect the gate terminal of transistor MN1 to the reference potential (i.e., turn off transistor MN1) in response to being turned on by PSEL and not connect the gate terminal of transistor MN1 to the reference potential (i.e., turn on transistor MN1) in response to being turned off by PSEL.

Buffer circuitry 110 operates in response to PSEL, PRE, SEL, ~ADDA, and ~ADDB to deassert output 142 during the pre-charge cycle and selectively assert output 142 during the selective discharge cycle.

During the pre-charge cycle, buffer cycle 110 ensures that output 142 is deasserted to turn off transistor MN1 and allow node 76 to pre-charge without being discharged across transistor MN1. To do so, a transistor MN11 operates as a capacitor on a node 144 where the capacitor is charged across a diode connected transistor MN5 by the pre-charge signal PRE during the pre-charge cycle. The charged capacitor turns on a transistor MN3 to connect the gate terminal of transistor MN1 to the reference potential and turn off transistor MN1 during the pre-charge cycle. A pass gate PASS3 controlled by the select signal SEL disconnects node 144 from the output of a NOR gate when turned off during the pre-charge cycle to allow node 144 to be charged by the pre-charge signal PRE.

In addition, the pre-charge signal PRE biases a node 146 in buffer cycle 110 during the pre-charge cycle to ensure that node 76 sufficiently discharges across transistor MN1, if selected to do so, during the subsequent selective discharge cycle. The pre-charge signal PRE charges a capacitor on node 146 that is formed by a transistor MN2 across a diode connected transistor MN7. PSEL turns on a transistor MN4 to connect the gate terminal of a transistor MN8 to the reference potential and turn off transistor MN8 during the pre-charge cycle to allow the capacitor node 146 to be charged.

During the selective discharge cycle, buffer circuitry 110 asserts output 142 if either or both of the address signals ~ADDA and ~ADDB are asserted and deasserts output 142 if both of the address signals ~ADDA and ~ADDB are deasserted. If asserted, output 142 causes node 76 to be discharged by discharge path circuitry 108 to turn off drive switch 72 and prevent firing resistor 52 from being energized. If deasserted, output 142 does not cause node 76 to be discharged by discharge path circuitry 108.

If either or both of the address signals are asserted, the NOR gate output is deasserted. The select signal SEL turns on the pass gate PASS3 to connect the output of the NOR gate with charge on the capacitor on node 144. Because the output of the NOR gate is deasserted, node 144 discharges through the NOR gate and turns off transistors MN3 and MN8. With transistors MN3 and MN8 turned off, node 146 remains charged and turns on a transistor MN6. As a result, the select signal asserts output 142 across a diode connected transistor MN10 and the turned on transistor MN6.

If both of the address signals are deasserted, the NOR gate output is asserted and combines with the charge on the capacitor on node 144 across the turned on pass gate PASS 3 to turn on transistors MN3 and MN8. Node 144 may be designed to have a higher capacitance that the NOR gate output node to ensure that transistors MN3 and MN8 will be turned on if the NOR gate output is asserted. Transistor MN8 discharges node 146 to turn off transistor MN6 and prevent the select signal from asserting output 142. Transistor MN3 pulls node 142 to the reference potential to deassert output 142.

In the above embodiment, transistors used to form the NOR gate may be kept relatively small to reduce the overall loading on the address drivers that drive the address signals ~ADDA and ~ADDB. Buffer circuitry 110 may be used to allow the output of the relatively small NOR gate transistor to drive a relatively large pulldown transistor MN1.

In other embodiments, the data signal may be used in addition to the address signals to control discharge path circuitry 108 and discharge path circuitry 106 may be omitted. In this embodiment, the NOR gate in buffer circuitry 110 receives the data signal along with the address signals. The NOR gate output is deasserted if any of the address or data signals are asserted and asserted if all of the address and data signals are deasserted. Accordingly, the data signal also controls the charge on the capacitor on node 144 during the selective discharge cycle. The data signal is generated such that it is valid prior to the select signal being asserted in this embodiment.

Figure 8:
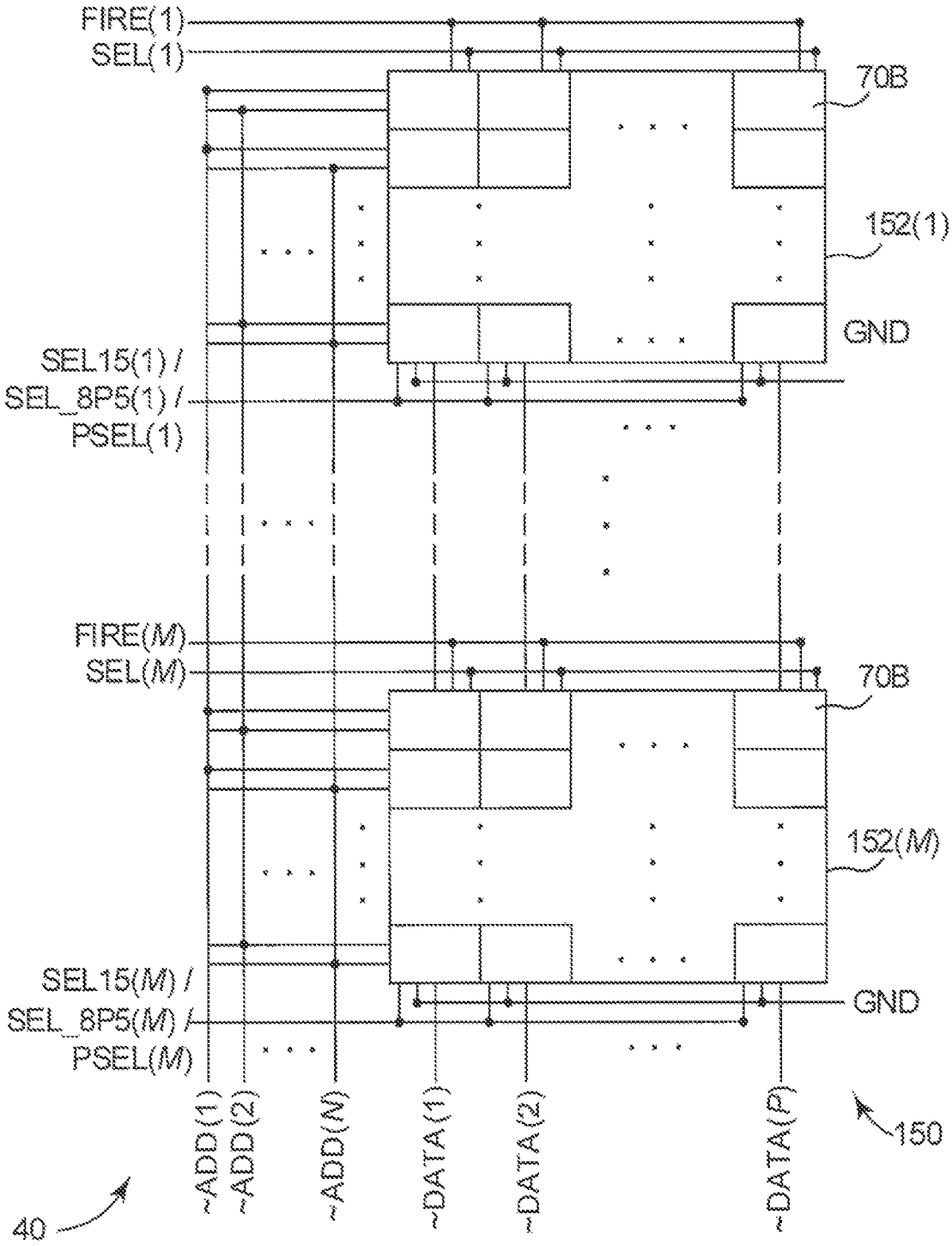
FIG. 8 is a diagram illustrating one embodiment of a printhead die with an array of pre-charged firing delis.

FIG. 8 is a diagram illustrating one embodiment of printhead die 40 with an array 150 of pre-charged firing cells 70

Array 150 is arranged into a set of fire groups 152(1)-152 (M), where M is in integer that is greater than or equal to one (e.g., M may be equal to four or six). Each fire group 152 includes firing cells 70 arranged into any suitable number of rows (e.g., 13 rows) and columns (e.g., 8 columns). Each row in a fire group 152 is selected using a respective pair of address signals ~ADD(1)-~ADD(N), were N is an integer that is greater than or equal to three. Each respective pair of address signals ~ADD(1)-~ADD(N) is connected to the ~ADDA and ~ADDB signals in each firing cell 70 in a respective row. Each column in a fire group 152 is selected using a respective data signal ~DATA(1)-~DATA(P), where P is an integer that is greater than or equal to one. Each respective data signal ~DATA(I)-~DATA(P) is connected to the ~DATA signal in each firing cell 70 in a respective column.

Fire groups 152(1)-152(M) are configured to receive fire signals FIRE(1)-FIRE(M), respectively, select signals SEL (1)-SEL(M), respectively, SEL15(1)-SEL15(M), respectively, SEL_8P5(1)-SEL_8P5(M) respectively, and PSEL(1)-PSEL(M), respectively. Fire groups 152(1)-152(M) each connect to a reference potential GND (e.g., ground).

In one embodiment, the select signal SEL for one fire group 152 may be synchronous with the SEL15, SEL_8P5, and PSEL signals for a subsequent fire group 152. For example, SEL(1) may be synchronous with SEL15(2), SEL_8P5(2), and PSEL(2), and SEL(2) may be synchronous with SEL15(3), SEL_8P5(3), and PSEL(3), etc. In other embodiments, the select signal SEL for one fire group 152 may be synchronous with or asynchronous with the SEL15, SEL_8P5, and PSEL signals for one or more other fire groups 152 in other suitable ways.

In other embodiments, fire groups 152(1)-152(M) may each have different numbers of rows and/or columns. In addition, each fire group 152 may have different numbers of firing cells 70 in different rows and/or columns in other embodiments.

Although specific embodiments have been illustrated and described herein for purposes of description of the embodiments, it will be appreciated by those of ordinary skill in the art that a wide variety of alternate and/or equivalent implementations may be substituted for the specific embodiments shown and described without departing from the scope of the present disclosure. Those with skill in the art will readily appreciate that the present disclosure may be implemented in a very wide variety of embodiments. This application is intended to cover any adaptations or variations of the disclosed embodiments discussed herein. Therefore, it is manifestly intended that the scope of the present disclosure be limited by the claims and the equivalents thereof.

What is claimed is:

1. A firing cell comprising:

a firing resistor;

a switch connected to a node to control current through the firing resistor;

a pre-charge transistor responsive to a controller to pre-charge the node to an active voltage level in response to a voltage pulse in a pre-charge signal; and a first transistor having a first terminal connected to the node and a second terminal connected to a reference potential, the first transistor responsive to the controller to selectively discharge the node to the reference potential in response to a voltage pulse in a select signal that occurs after the voltage pulse in the pre-charge signal.

2. The firing cell of claim 1 further comprising:

a second transistor having a first terminal connected to the node and a second terminal connected to the reference potential to selectively discharge the node to the reference potential.

3. The firing cell of claim 2 wherein the first transistor is to selectively discharge the node to the reference potential in response to at least one address signal, and wherein the second transistor is to selectively discharge the node to the reference potential in response to a data signal.

4. The firing cell of claim 1 further comprising:

a distributed level shifter to generate the pre-charge signal from an input signal and to generate an attenuated signal from the input signal.

5. The firing cell of claim 4 further comprising:

buffer circuitry to be biased by the pre-charge signal to control the operation of the first transistor.

6. The firing cell of claim 1 wherein the firing resistor, the switch, the pre-charge transistor, and the first transistor are formed using a CMOS process.

7. The firing cell of claim 1 wherein the switch includes a second transistor with a gate connection directly coupled to the node.

8. A firing cell comprising:

a firing resistor;

a switch connected to a node to control current through the firing resistor;

a pre-charge transistor responsive to a controller to pre-charge the node;

a first transistor having a first terminal connected to the node and a second terminal connected to a reference potential, the first transistor responsive to the controller to selectively discharge the node to the reference potential; and a second transistor having a third terminal connected to the node and a fourth terminal connected to the reference potential, the second transistor responsive to the controller to selectively discharge the node to the reference potential.

9. The firing cell of claim 8 wherein the first transistor is to selectively discharge the node to the reference potential in response to at least one address signal, and the second transistor is to selectively discharge the node to the reference potential in response to a data signal.

10. A firing cell comprising:

a firing resistor;

a switch connected to a node to control current through the firing resistor;

a pre-charge transistor responsive to a controller to pre-charge the node;

a first transistor having a first terminal connected to the node and a second terminal connected to a reference potential, the first transistor responsive to the controller to selectively discharge the node to the reference potential; and a distributed level shifter to generate a pre-charge signal from an input signal and to generate an attenuated signal from the input signal, wherein the first transistor is to be selectively turned off by the attenuated signal to pre-charge the node and the pre-charge transistor is to pre-charge the node using the pre-charge signal.

11. The firing cell of claim 10 wherein the pre-charge transistor is to receive the pre-charge signal as a diode connected transistor to pre-charge the node.

12. The firing cell of claim 10 comprising:

buffer circuitry to be biased by the pre-charge signal to control the operation of the first transistor.

* * * * *